US011202473B2

(12) United States Patent
Mohammadian-Khezerlou et al.

(10) Patent No.: US 11,202,473 B2
(45) Date of Patent: Dec. 21, 2021

(54) ADJUSTABLE SIZE SHIRT COLLAR SUPPORT

(71) Applicant: LuxeAvant Innovations, Inc., West Vancouver (CA)

(72) Inventors: Arash Mohammadian-Khezerlou, Vancouver (CA); Behzad Ghods-Mahmoudzadeh, Vancouver (CA); Pedram Hosseini, Vancouver (CA); Arash Ross Seyed, Vancouver (CA)

(73) Assignee: LuxeAvant Innovations, Inc., West Vancouver (CA)

( * ) Notice: Subject to any disclaimer, the term of this patent is extended or adjusted under 35 U.S.C. 154(b) by 96 days.

(21) Appl. No.: 16/734,762

(22) Filed: Jan. 6, 2020

(65) Prior Publication Data

US 2020/0221790 A1 Jul. 16, 2020

Related U.S. Application Data

(60) Provisional application No. 62/790,864, filed on Jan. 10, 2019.

(51) Int. Cl.
*A41B 3/06* (2006.01)

(52) U.S. Cl.
CPC ..... *A41B 3/06* (2013.01)

(58) Field of Classification Search
CPC .. A41B 3/06; A41B 3/08; A41B 3/005; A41H 33/00
USPC ..... 2/255, 132, 134, 138–140, 141.2, 127, 2/155, 156; 223/2, 4, 27
See application file for complete search history.

(56) References Cited

U.S. PATENT DOCUMENTS

| | | | | |
|---|---|---|---|---|
| 811,326 | A * | 1/1906 | Reynolds | |
| 1,764,212 | A * | 6/1930 | Kirsten | A41B 3/06 2/132 |
| 2,475,931 | A * | 7/1949 | Wimmer | A41B 3/12 2/138 |
| 2,610,774 | A * | 9/1952 | Calder | B65D 85/182 223/83 |
| 2010/0313331 | A1* | 12/2010 | English | A41B 3/06 2/132 |
| 2011/0173740 | A1* | 7/2011 | Franklin | A41B 1/10 2/255 |
| 2014/0223640 | A1* | 8/2014 | English | A41B 3/06 2/256 |
| 2015/0020290 | A1* | 1/2015 | Yarbrough | A41B 3/06 2/129 |

(Continued)

*Primary Examiner* — Gloria M Hale
(74) *Attorney, Agent, or Firm* — Boyle Fredrickson S.C.

(57) ABSTRACT

A collar support device functions as an adjustable support structure for a collar on a garment. The collar support device can accommodate a wide range of shirt collar and neck sizes, with the device provides additional structural integrity to a shirt collar to resist folding, puckering, bending, or slipping under a heavier garment worn over the shirt, i.e. a jacket. The collar can be readily concealed within the collar and includes a pair of components that can be adjustably secured to one another in order to accommodate the particular size collar with which the device is used. The rigid yet flexible structure of the components of the device are designed to naturally move with the garment and wearer's body movements, while simultaneously providing the right amount of rigidity to the collar.

14 Claims, 8 Drawing Sheets

(56) References Cited

U.S. PATENT DOCUMENTS

| | | | | |
|---|---|---|---|---|
| 2020/0037672 | A1* | 2/2020 | Moczygemba | A41B 3/06 |
| 2020/0146362 | A1* | 5/2020 | Smith | A41B 3/06 |

* cited by examiner

ADJUSTABLE SIZE SHIRT COLLAR SUPPORT

CROSS-REFERENCE TO RELATED APPLICATION

The present application claims priority from U.S. Provisional Patent Application Ser. No. 62/790,864, filed on Jan. 10, 2019, the entirety of which is expressly incorporated herein by reference in its entirety for all purposes.

FIELD OF THE DISCLOSURE

The present disclosure generally pertains to clothing and fashion accessories and more particularly to improving the look of shirt collars of all sizes. This device is intended to be used by men and women by inserting the device disclosed herein into the back of a folded shirt collar in order to create an internal rigid skeletal, yet flexible structure that will assist in maintaining the collar's structural integrity. This added structural integrity assists the shirt collar resist folding, puckering, bending, or slipping under a heavier garment worn over the shirt collar, i.e. a jacket.

BACKGROUND OF THE DISCLOSURE

One issue with shirts and other items of clothing incorporating a collar formed of a fabric material is that the collar can often be deformed as a result of washing and/or contact with other items of clothing that are worn over or around the collar of the shirt. The nature of the material forming the collar allows it to conform to the body of the wearer when worn, but also readily collapse when contacted by other items.

One prior art solution to this issue has been using starch to stiffen the material forming the collar, thereby enabling the collar to more readily maintain its shape. However, certain drawbacks to the use of starch include the requirement to have the starch added outside of the home in a commercial laundry, requiring additional time and expense to the individual, and the loss of the softness of the fabric forming the collar as a result of the addition of the starch, causing the shirt and collar to become significantly less comfortable to wear.

As an alternative to the use of starch to stiffen the collar, other known products have been developed to attempt to solve the problems with fabric collars but without the drawbacks of starch. One such product is disclosed in Moldable Collar Stay for Shirts US Patent Application Publication No. US 2010/0313331 A1 incorporated herein by reference in its entirety for all purposes. This product is a moldable collar stay for a shirt collar which traverses the periphery of the shirt collar with each end of said moldable stay being inserted into the prefabricated collar stay pockets of the shirt. The moldable collar stay may be either hidden permanently within the shirt fabric forming the collar, or rest removably underneath the periphery of the shirt collar. The moldable stay body includes two end points which are identically formed and connected by a moldable material concomitant with the periphery of the shirt collar.

Another product attempting to address this issue is the placket straightener disclosed in US Patent Application Publication No. US2011/0173740 A1, incorporated herein by reference in its entirety for all purposes. The placket straightener device minimizes buckling, gapping, or puckering of the overlapping placket panels on the ends of a shirt, such as a woman's blouse, when the fasteners, such as snap buttons or buttons with buttonholes, are fastened together. The placket straightener may be placed inside of the placket panel(s) or the device may be placed between two overlapping placket panels and engaged between the closed fasteners. The placket straightener device maintains a predetermined distance between the closed fasteners of the shirt thereby reducing buckling, gapping and puckering between the closed fasteners.

As these prior art devices fail to adequately enable an individual to maintain the desired appearance of a collar without having to affix the device to the garment in some manner, it is desirable to develop a device that can overcome the deficiencies of the prior art.

SUMMARY OF THE DISCLOSURE

According to one exemplary aspect of the present disclosure, a collar support device functions as an adjustable support structure for a collar. The collar support device can accommodate a wide range of shirt collar and neck sizes, with the said device providing additional structural integrity to a shirt collar in assisting the shirt collar resist folding, puckering, bending, or slipping under a heavier garment worn over the shirt, i.e. a jacket. The collar can be readily concealed within the collar and includes a pair of components that can be adjustably secured to one another in order to accommodate the particular size of the collar with which the device is used. The rigid yet flexible structure of the components of the collar support device are designed to naturally move with the garment and wearer's body movements, while simultaneously providing the right amount of rigidity to the shirt collar that prevents it from folding, puckering, bending, or slipping under a heavier garment worn over the shirt.

According to another exemplary aspect of the disclosure, the collar support device is not attached directly to the garment when in use. The shape of the support device compressively engages the collar and wearer to retain the collar support device in position within the collar, while also enabling the collar support device to readily be withdrawn from the collar, even when the collar is still worn by the wearer.

The collar support device of the present disclosure is made from lightweight, rigid yet flexible material that is adjustable in size to fit a wide range of shirt collar sizes. It is designed in the shape of a shirt collar with a wrap-around "U" shaped structure that is inserted into the back of an unfolded shirt collar, held in place by folding the shirt collar back down so that the shirt collar securely hugs the device. The device is additionally held in place by the device's built-in pinching feature provided by the shape of the device in conjunction with the resiliency of the material forming the device that further secures the device in place by lightly yet firmly wrapping itself around the inner part of the shirt collar. The inserted device functions as an internal skeletal-like structure that provides the collar with additional structural integrity. The distal inferior parts of the said device are equipped with two extended protrusions that sit over each shoulder where the neck meets the trapezius.

The present disclosure is a collar support device formed of two parts that are similar in structure, with the two parts each possessing parts of a complimentary attachment mechanism in the anterior parts that functions as the overall size adjustment mechanism to enable the device to accommodate a wide range of collar sizes. This adjustment mechanism allows the two parts to be attached to each other at various length settings, thereby, shortening or lengthening the product's "U" shaped structure for a custom collar fit. This size adjustment function allows the device to accommodate various men and women's shirt collar sizes.

Other aspects, advantages and features of the invention of the present disclosure will be made apparent from the following detailed description taken together with the drawing figures.

BRIEF DESCRIPTION OF THE DRAWINGS

The drawings illustrate the best mode currently contemplated of practicing the present invention. Exemplary embodiments of the article of furniture are shown in the accompanying drawings. It should be appreciated that like reference numbers used in the drawings may identify like components.

DETAILED DESCRIPTION OF THE DRAWINGS

Figure 1:
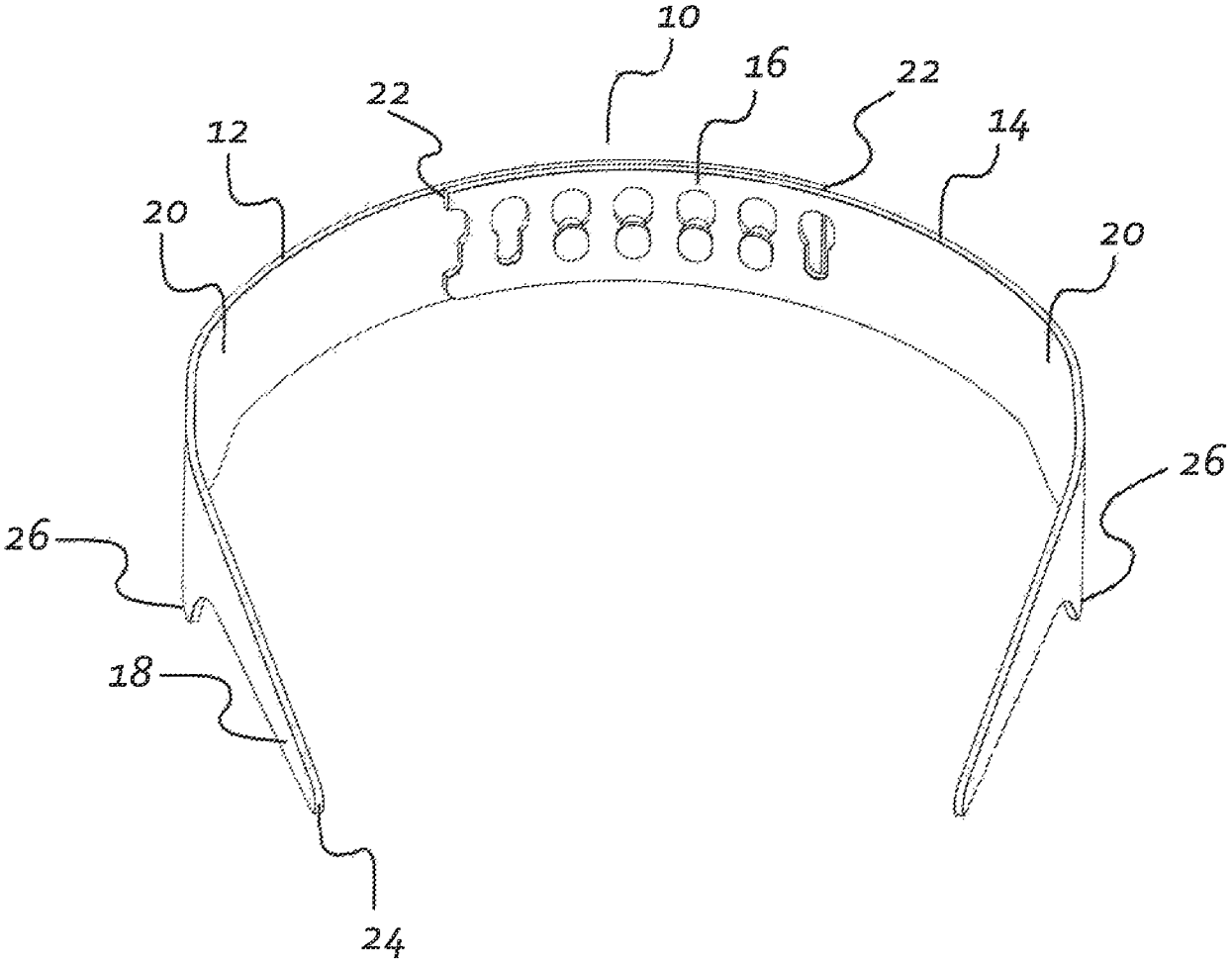
FIG. 1 is a isometric front view of a collar support device constructed according to an exemplary embodiment of the present disclosure.
Figure 2:
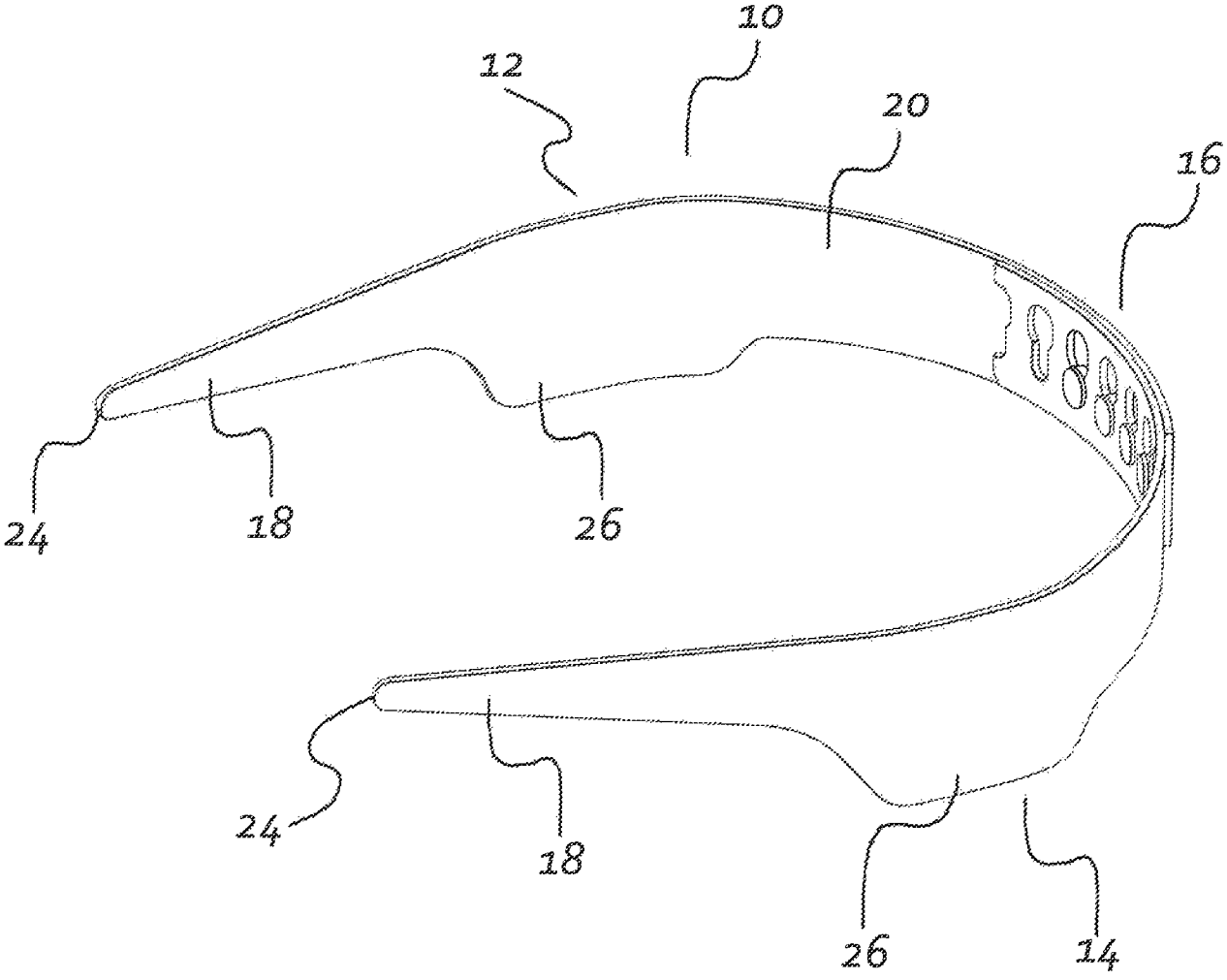
FIG. 2 is a right side isometric view of the collar support device of FIG. 1.
Figure 3:
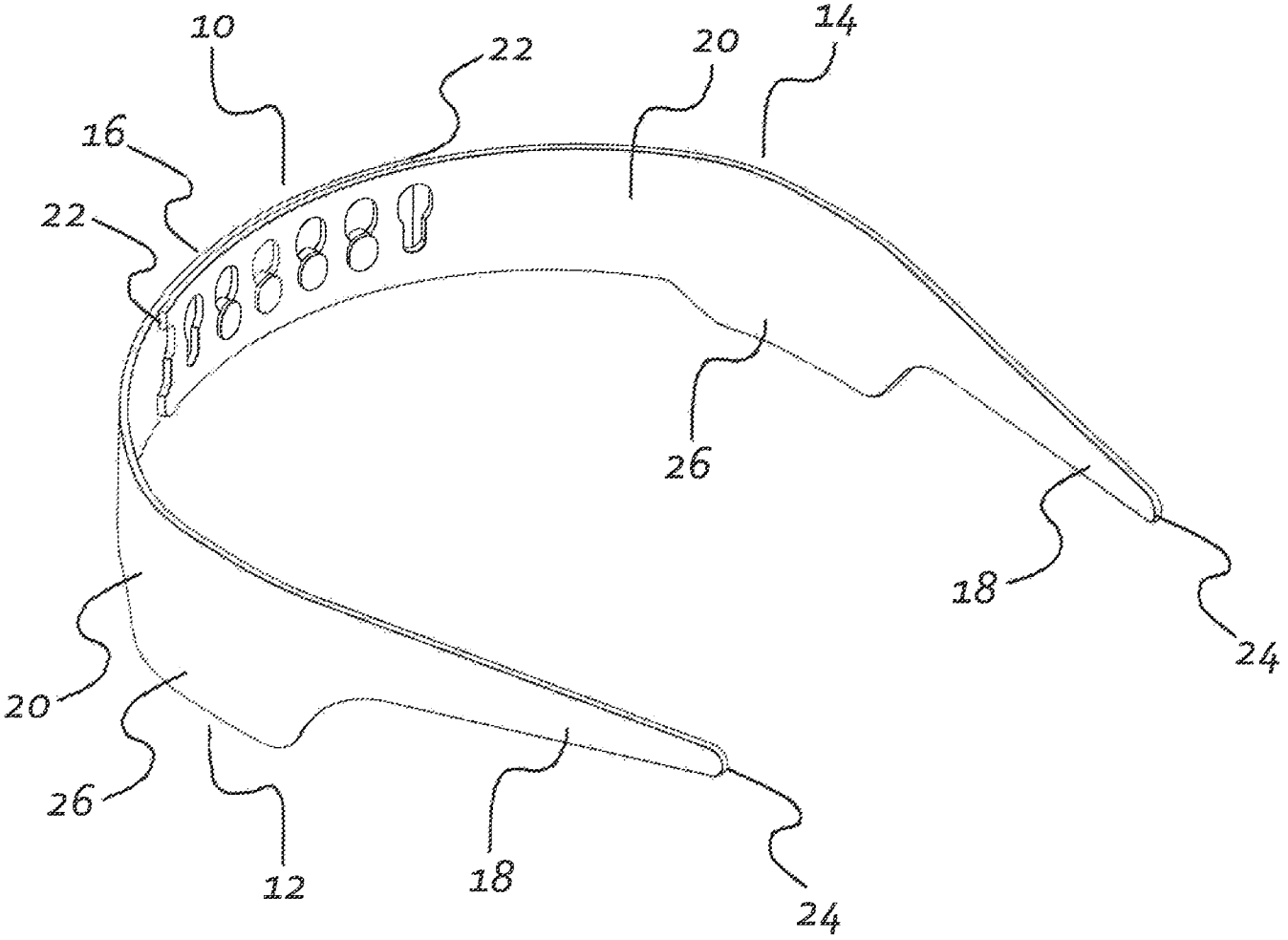
FIG. 3 is a left side isometric view of the collar support device of FIG. 1.
Figure 4:
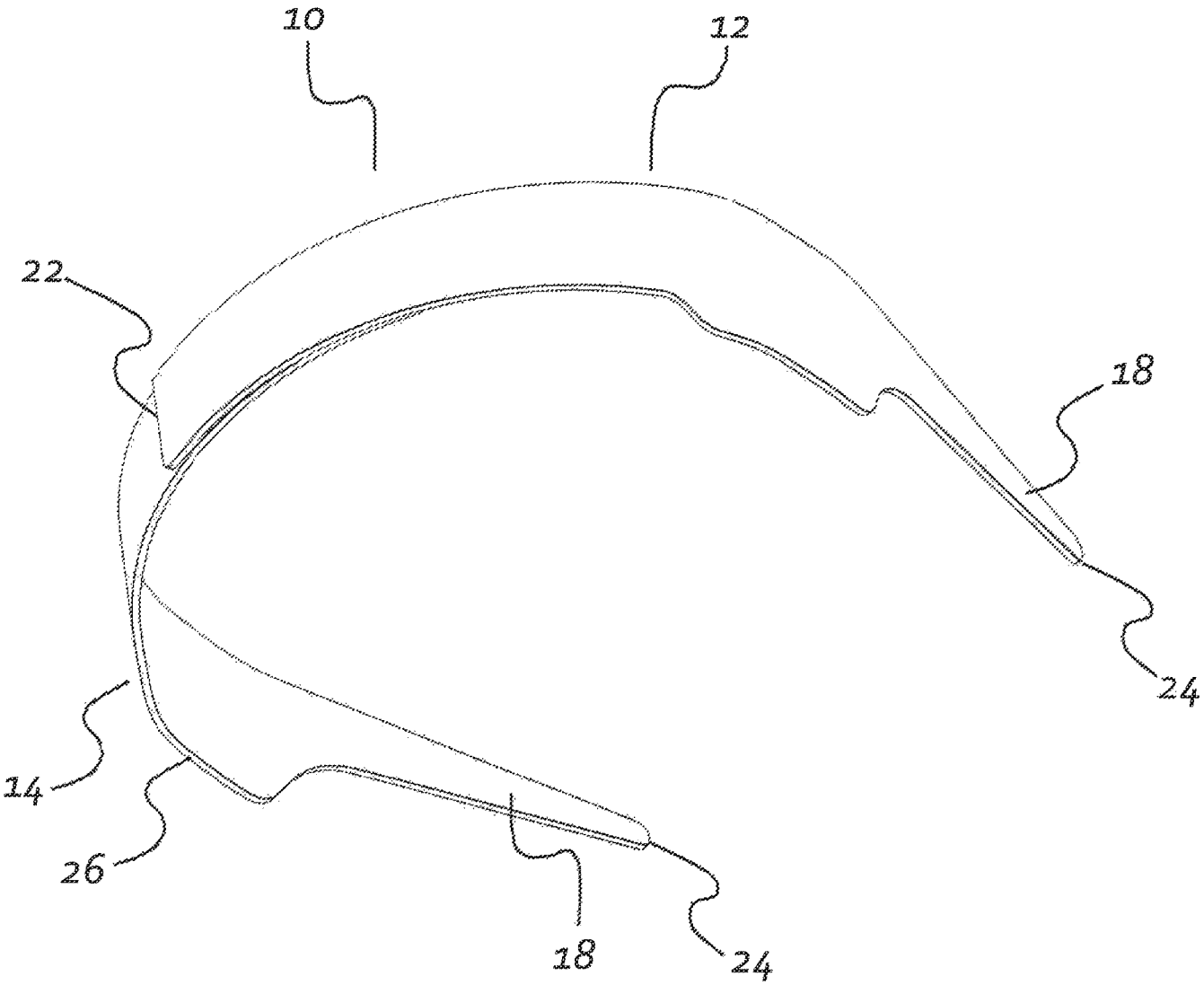
FIG. 4 is rear isometric view of the collar support device of FIG. 1.
Figure 5:
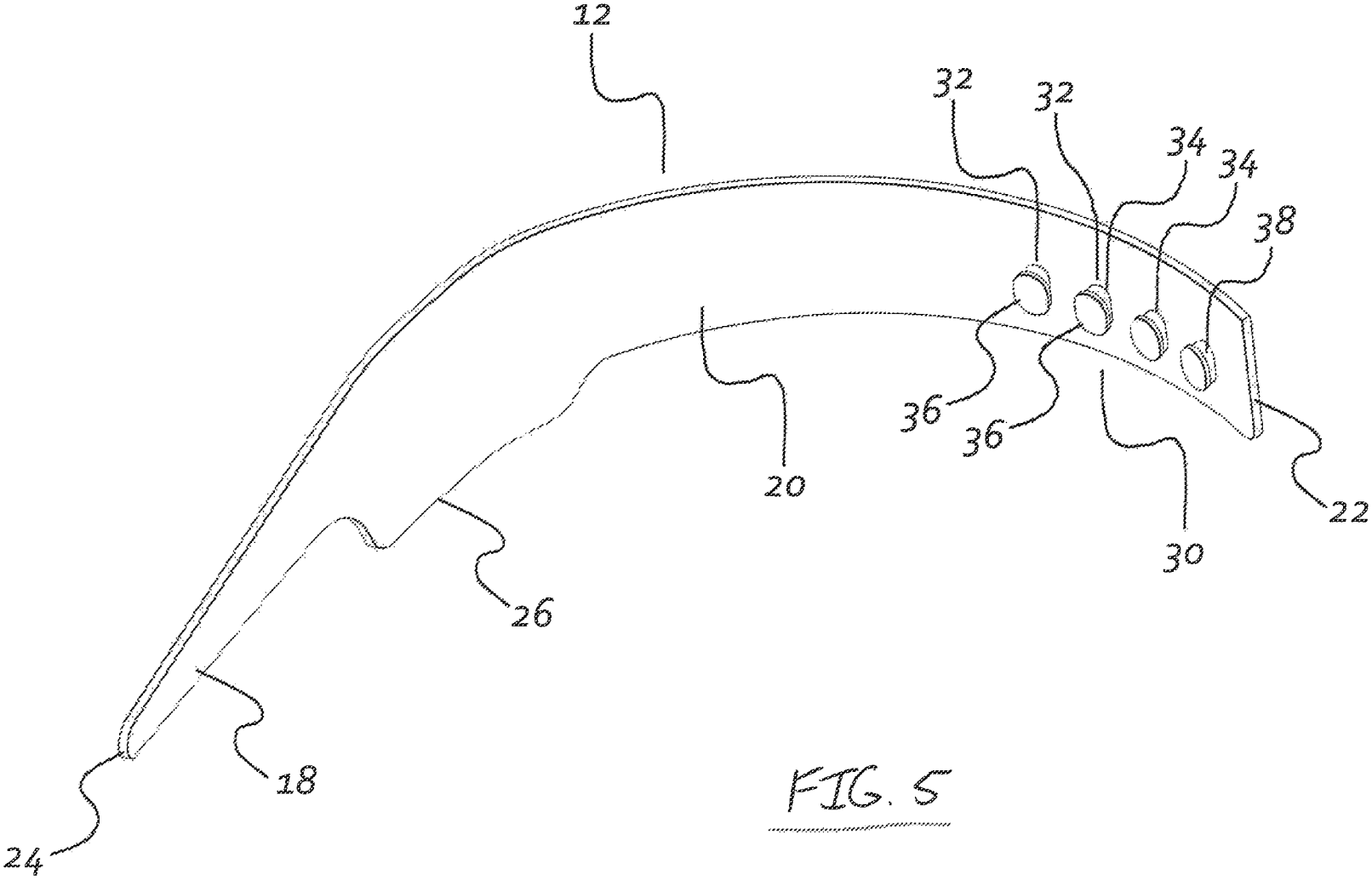
FIG. 5 is an isometric view of a first component of the collar support device of FIG. 1.

With reference now to the drawing figures in which like reference numerals designate like parts throughout the disclosure, an exemplary embodiment of a collar support device is illustrated generally at 10 in FIGS. 1-4. The collar support device 10 includes a first component 12 that is releasably and adjustably secured to a second component 14 using an adjustment mechanism 16 to form the device 10.

Figure 7:
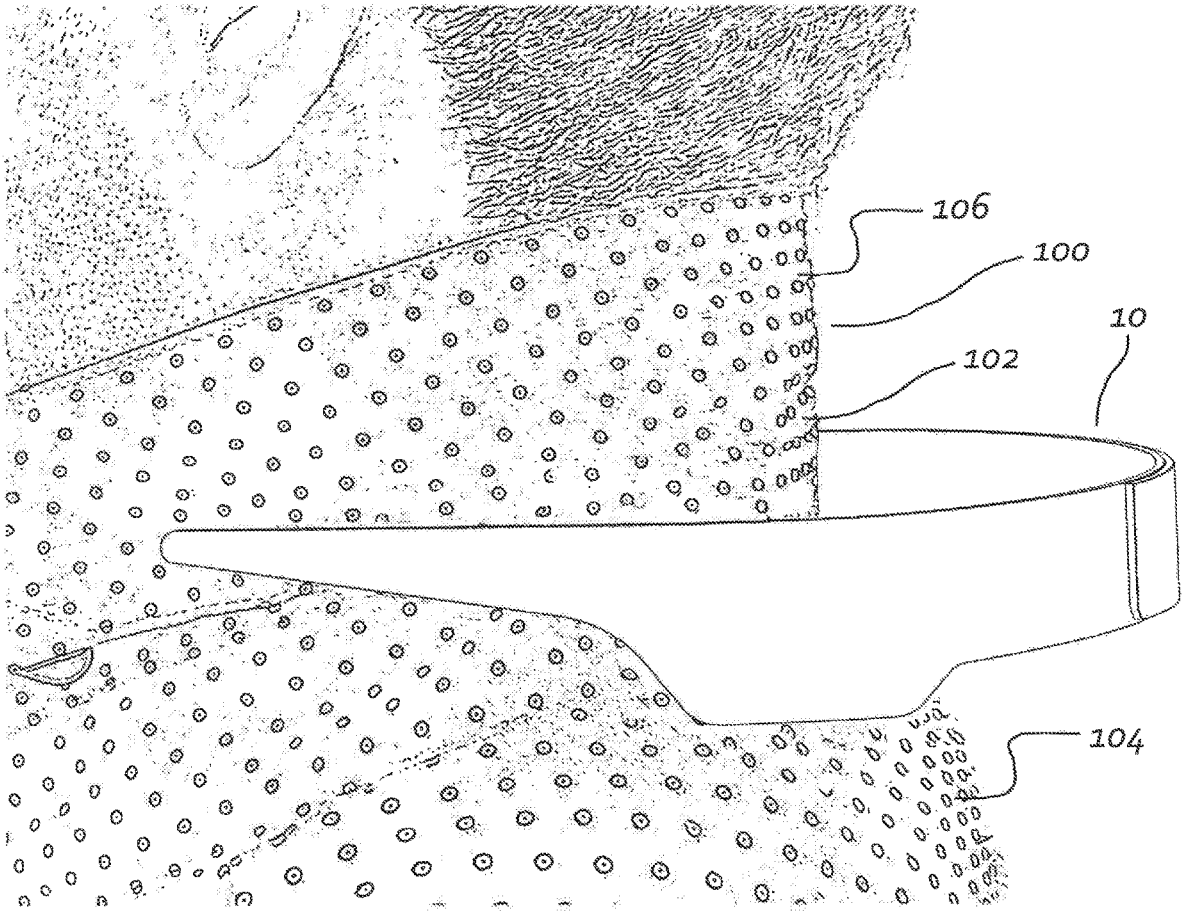
FIG. 7 is a perspective view of the collar support device engaged with a collar on a garment.

In the illustrated exemplary embodiment of FIGS. 1-4 the collar support device 10 has a generally U-shape with the first component 12 and the second component 14 being formed as virtual mirror images of one another. In the illustrated exemplary embodiment of FIGS. 1-5, the first component 12, includes a first end 18, a body 20 and a second end 22 disposed opposite the first end 18. The first end 18 is tapered to assist the first end 18 in being properly positioned within the collar 100 (FIG. 7) being supported by the device 10 and terminates in a rounded tip 24. The first end 18 expands as it extends towards the body 20 to assist in providing the support to the collar 100. The body 20 includes a shoulder 26 located adjacent the first end 18. The shoulder 26 includes a rounded lower edge 28 that can engage the body of the wearer in a manner that assists in maintaining the position of the device 10 relative to the collar 100. As the body 20 extends away from the shoulder 26 opposite the first end 18, the body 20 has a generally rectangular shape until reaching a flat edge 29 of the second end 22.

Adjacent the second end 22, the body includes a first portion 30 of the adjustment mechanism 16, which can be formed of any suitable adjustment mechanism, such as snaps, buttons, key-into-key-hole, locking, clip attachment mechanisms or other similar attachment and/or attachment mechanisms. As shown in the exemplary illustrated embodiment of FIG. 5, the first portion 30 is formed as a number of aligned and spaced tabs 32 extending inwardly from the body 20. Each tab 32 includes a stem 34 connected to and extending outwardly from the body 20 and a head 36 disposed on the stem 34 opposite the body 20 to define a space 38 between the head 36 and the body 20.

Figure 6:
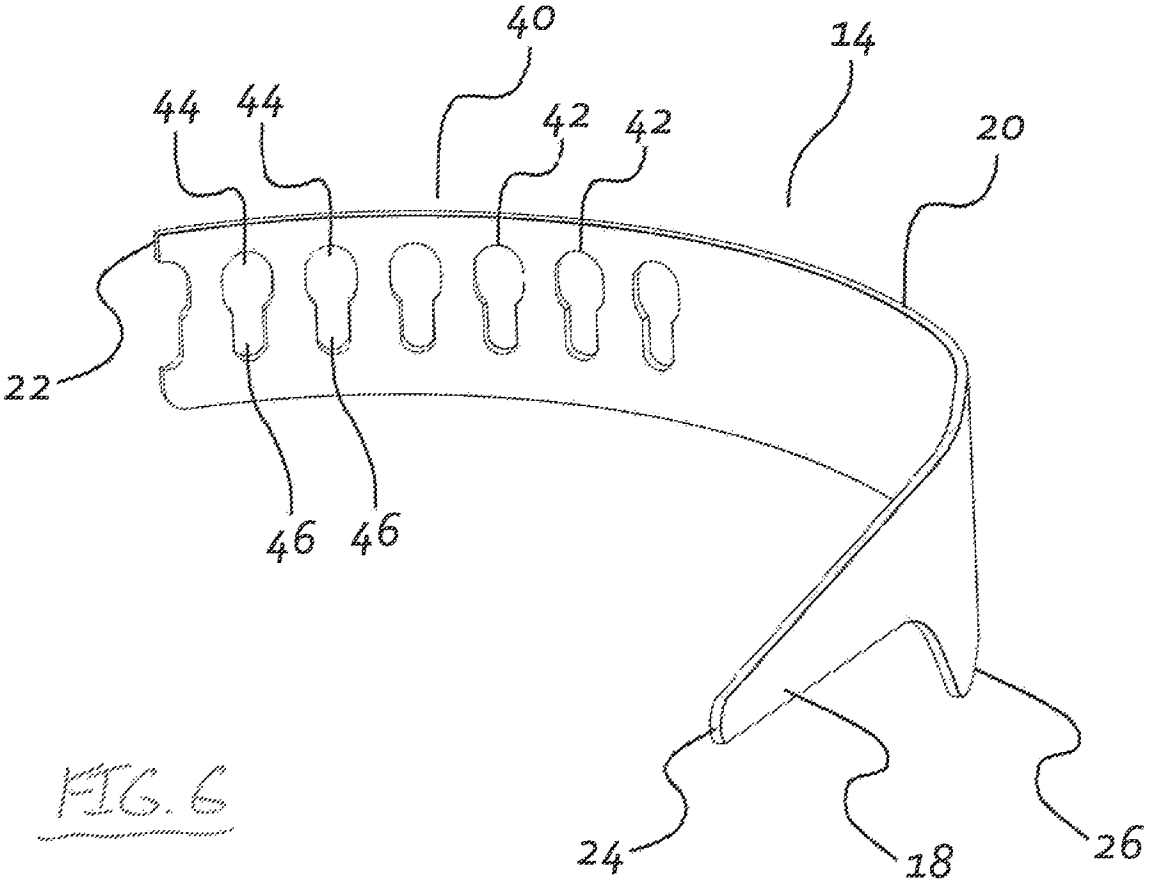
FIG. 6 is an isometric view of a second component of the collar support device of FIG. 1.

Referring now to the illustrated exemplary embodiment of FIG. 6, the second component 14 is formed a virtual mirror image of the first component 12, including the first end 18 and rounded tip 24, and the body 20 with shoulder 26 and flat edge 29 forming the second end 22. However, on the body 20 adjacent the second end 22, the second component 14 includes a second portion 40 of the adjustment mechanism 16. The second portion 40 is formed of a number of aligned and spaced apertures 42 located in the body 20. The apertures 42 each include a wide upper section 44 and a narrow lower section 46.

Figure 8:
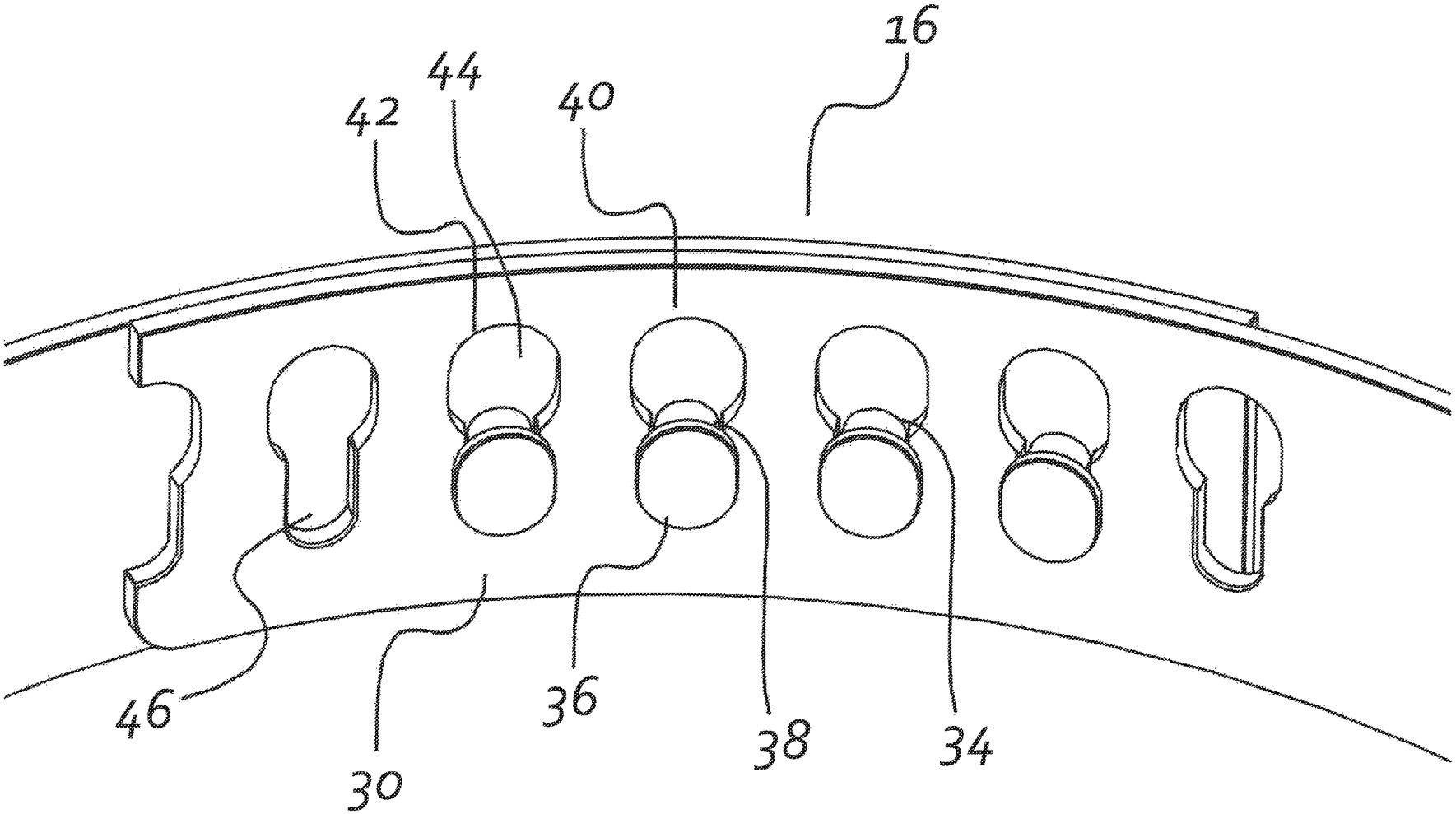
FIG. 8 is a partially broken away, isometric view of an exemplary embodiment of an adjustment mechanism of the collar support device of FIG. 1

Looking now at FIG. 8, to operate the adjustment mechanism 16, the first component 12 is positioned in alignment with the second component 14 at a position where the combined length of the first component 12 and the second component 14 conforms to the length of the collar 100 to be supported by the device 10. In this position, the heads 36 of the tabs 32 on the first portion 30 that are aligned with corresponding apertures 42 in the second portion 14 are inserted through the wide upper sections 44 of the corresponding apertures 42. Once inserted through the upper sections 44, the tabs 32 are slid downwardly along the apertures 42 until the stems 34 are positioned within the narrow lower sections 46 of each aperture 42. In this position, the head 36 of the tabs 32 engage the body 20 of the second component 14 around the lower sections 46 to hold the first component 12 in engagement with the second component 14 to form the device 10.

In this configuration, the first ends 18 of the first component 12 and the second component 14 define a narrow open end 50 of the device 10 through which the collar 100 and neck or other body part of the individual can be inserted into the device 10. The first ends 18 can be deflected with regard to the remainder of the device 10 when engaging the device 10 with the collar 100 due to the flexible and resilient nature of the material(s) forming the device 10, with the first ends 18 being urged into compressive engagement with the collar 100 as a result of this resiliency. In the illustrated exemplary embodiment of FIGS. 1 and 7, the device 10 is only frictionally engaged with the collar 100 and is not directly connected to the collar 100 or any other portion of the garment including the collar 100, thereby increasing the ease of use of the device 10 with the collar 100, Referring now to FIG. 7, the device 10 when assembled can be positioned in engagement with the collar 100. To do so, the first end 18 are deflected outwardly against the bias provided by the U-shape and material forming the device 10 to widen the open end 50 to accommodate the size of the collar 100 being positioned therein. The device 10 is aligned with the lower part 102 of the collar 100 with the first ends 18 pinching against the lower part 102 and the neck of the wearer, but in an exemplary embodiment without any connection of the first ends 18 or any portion of the device 10 to the collar 100 or the garment 104 including the collar 100. In the aligned position the first ends 18 are disposed near the front ends (not shown) of the collar 100 with the first ends 18 defining an open end 50 having a width smaller than the collar 100/individual's neck. Additionally, the shoulders 26 are located in engagement with the body of the wearer to hold the device 10 in a stable vertical position relative to the collar 100.

Once the device 10 is positioned around the lower part 102 of the collar 100, the upper part 106 of the collar 100 can be folded down over the device 10 and optionally secured in position, such as by engaging the upper part 106 with buttons (not shown) or other securing devices (not shown) on the garment. The device 10 is then located and concealed within the space 108 defined between the lower part 102 and the upper half 106 of the collar 100 to provide support for the collar 100 in an unobtrusive and/or hidden manner.

To remove the device 10, either with or without displacing the upper part 106 of the collar 100, the device 10 can be grabbed and pulled away from the collar 100. Doing so displaces the first ends 18 from one another to allow the collar 100 to pass thought the open end 50. Once removed, the device 10 can be disassembled by removing the heads 36 on the first portion 12 from the apertures 42 in the second portion 14 such that the device 10 can be reassembled to accommodate another collar size.

In an exemplary embodiment of the disclosure, the adjustment mechanism 16 includes a greater number of apertures 42 than tabs 32 in order to enable a larger number of sizes of collar 100 to be accommodated by the device 10. Further, the apertures 42 are disposed on the second component 14 where the first component 12 is aligned with the second component 14 when the tabs 32 are fully inserted and engaged with the apertures 42 to form the device 10. Additionally, the device 10 can be formed from a flexible but shape-retaining material, such as a plastic material formed in any suitable molding or pother forming process. The first component 12 and the second component 14 of the device 10 are each formed with a generally U-shape that when combined form a U-shape for the device 10 that is similar in shape to a collar 100.

In addition to the several aspects and advantages of the present disclosure which have been described and illustrated, it should be noted that various additional aspects and advantages of the present invention may be envisioned by those persons who are skilled in the garment art and are intended to be encompassed within the scope of the following claims particularly pointing out and distinctly claiming and the subject matter regarded as the invention.

We claim:

1. A collar support device for supporting a collar on a garment, the device comprising:

a. a first component including a body having a first end and a second end;

b. a second component including a body having a first end a second end;

c. an adjustment mechanism having a first portion disposed on the first component and a complementary second portion disposed on the second component; and d. a shoulder on each body of the first component and the second component, the shoulder adapted to engage the wearer to maintain the device in position relative to the collar.

2. The collar support device of claim 1 wherein the first portion includes at least one tab having a stem extending outwardly from the first component and a head disposed on the stem opposite the first component.

3. The collar support device of claim 2 wherein the second portion includes at least one aperture formed in the second component.

4. The collar support device of claim 3 wherein the at least one aperture has a wide upper section and narrow lower section.

5. The collar support device of claim 4 wherein the second portion includes a greater number of apertures than a number of tabs on the first portion.

6. The collar support device of claim 1 wherein the first ends define a narrow open end of the device.

7. The collar support device of claim 1 wherein the device is not connected to any portion of the garment including the collar.

8. The collar support device of claim 1 wherein the device is adapted to only frictionally engage the collar.

9. The collar support device of claim 1 wherein the first component and the second component are formed as mirror images of one another.

10. The collar support of claim 1 wherein the adjustment mechanism operates to attach the first component to the second component to form the device.

11. The collar support device of claim 1 wherein the first portion of the adjustment mechanism and the second portion of the adjustment mechanism are each located adjacent the second ends of the first component and the second component.

12. A method for providing support to a collar of a garment, the method comprising the steps of:

a. providing the collar support device of claim 1;

b. engaging the first portion of the adjustment mechanism with the second portion of the adjustment mechanism to properly size the device; and c. engaging the device with the collar, wherein the first component and the second component each further comprise a shoulder on each body of the first component and the second component and wherein the step of engaging the device with the collar comprises placing the shoulders on the first component and the second component in engagement with the wearer.

13. The method of claim 12 wherein the step of engaging the device with the collar comprises deflecting the first ends of the first component and the second component apart from one another to allow the collar to be inserted through an open end of the device.

14. The method of claim 12 wherein the step of engaging the first portion of the adjustment mechanism with the second portion of the adjustment mechanism to properly size the device comprises engaging at least one tab having a stem extending outwardly from the first component and a head disposed on the stem opposite the first component within at least one aperture formed in the second component.

* * * * *